United States Patent [19]

Sweat, Jr. et al.

[11] 4,347,786

[45] Sep. 7, 1982

[54] IMPACT PRINTER HAMMER FLIGHT TIME AND VELOCITY SENSING MEANS

[75] Inventors: Robert H. Sweat, Jr., Round Rock; William J. Thornhill, Austin, both of Tex.

[73] Assignee: International Business Machines Corporation, Armonk, N.Y.

[21] Appl. No.: 80,890

[22] Filed: Oct. 1, 1979

[51] Int. Cl.[3] ..... B41J 7/92

[52] U.S. Cl. ..... 101/93.03; 400/144.2; 400/144.3; 400/157.3; 400/166

[58] Field of Search ..... 101/93.03, 93.29-93.36, 101/93.48; 400/144 V, 144.3, 157.3, 166

[56] References Cited

U.S. PATENT DOCUMENTS

| | | | |
|---|---|---|---|
| 3,490,010 | 1/1970 | Bernard et al. | |
| 3,574,326 | 4/1971 | Koehn | 400/144.2 |
| 3,740,615 | 6/1975 | Vigini . | |
| 3,840,105 | 10/1974 | Kittredge | 400/144.2 |
| 3,858,509 | 1/1975 | Grundherr | 101/93.19 |
| 3,988,664 | 10/1976 | Beery et al. | |
| 4,035,781 | 7/1977 | Chang | 364/900 |
| 4,103,617 | 8/1978 | O'Brien et al. | 101/93.03 |
| 4,103,766 | 8/1978 | Ruble et al. | 400/144.2 |
| 4,147,438 | 4/1979 | Sandrone et al. | 400/166 X |
| 4,173,927 | 11/1979 | Van Kempen et al. | 101/93.03 |
| 4,189,246 | 2/1980 | Kane et al. | 400/166 X |
| 4,192,230 | 3/1980 | Blom et al. | 400/144.2 X |

FOREIGN PATENT DOCUMENTS

| | | | |
|---|---|---|---|
| 2244627 | 4/1974 | France . | |
| 2008285 | 10/1978 | United Kingdom . | |
| 258318 | 4/1970 | U.S.S.R. | 400/166 |

OTHER PUBLICATIONS

Deetz, Xerox Discl. Journal, vol. 4, No. 2, Mar./Arp. 1979, p. 153.

IBM Tech. Discl. Bulletin, Mills et al, vol. 15, No. 8, Jan. 1973, p. 2356.

Mathews, IBM Tech. Discl. Bulletin, vol. 21, No. 12, May 1979, p. 4763.

*Primary Examiner*—Edward M. Coven

*Attorney, Agent, or Firm*—J. B. Kraft

[57] ABSTRACT

In an impact printer including a print wheel having a plurality of selectable character type bearing elements for respectively printing a plurality of characters, said print wheel being rotatable for selectively positioning selected type elements in successive print positions, impact means impellable against the selected elements to drive said elements against the printing medium and means for impelling the impact means against said selected type element, the present invention provides the improvement comprising means for sensing the flight time of the impelled impact means until impact by sensing variations in velocity of said impact means and means responsive to said sensed flight time for controlling the impelling means to vary the flight time. In accordance with another aspect of the present apparatus, means are provided for detecting the coincident engagement of the impact means with a type element by also sensing the velocity of the impact means after the impact means has reached a predetermined coincident engagement position.

10 Claims, 9 Drawing Figures

IMPACT PRINTER HAMMER FLIGHT TIME AND VELOCITY SENSING MEANS

DESCRIPTION

Background of the Invention

1. Field of the Invention

The present invention relates to impact printers and more particularly it relates to detecting the velocity and flight time to impact of the impact means or hammer of such impact printer.

2. Description of Prior Art

Impact printers which utilize a print wheel, i.e., rotating disk with characters on the periphery thereof are well known. Several of such printers are commercially available. Rotating disk printers can be divided in categories by either focusing on how the disk rotates or by focusing on how the carrier traverses.

Focusing on how the disk rotates, such printers can be divided into a first category where the disk constantly rotates and into a second category where the motion of the disk is intermittent. In printers with a constantly rotating disk, printing takes place when the hammer strikes the rotating disk. Rotation of the disk is not stopped each time a character is printed. In printers with a disk that intermittently rotates, the disk is rotated to the desired print position and then stopped. There is no disk rotation while printing takes place.

An alternate division of disk printers can be made by focusing upon the motion of the carrier. In some printers, the traverse of the carrier is stopped each time printing takes place. In other printers, the carrier is moving at the instant when printing occurs. In both the type where the carrier is moving when printing occurs and in the type where the carrier is stopped when printing occurs, the disk may or may not be rotating at the time of printing. In some printers where the carrier is moving at a fixed speed when printing takes place, the carrier is slowed down and stopped between print positions in order to give the rotating disk time to move to the desired character.

The following are some of the issued and pending patents which show rotating disk printers:

The Willcox U.S. Pat. No. 3,461,235 issued Aug. 12, 1969 shows a disk printer with a constantly rotating disk. The carrier stops at each print position.

The Ponzano U.S. Pat. No. 3,707,214, issued Dec. 26, 1972, discloses a disk printer which has separate controls for a print wheel and its carrier. The print wheel and the carrier move by the shortest distance at the next selected position. The print wheel and the carrier stop at each print position.

The Robinson U.S. Pat. No. 3,356,199, issued Dec. 5, 1967, describes a rotating disk printer wherein the disk is constantly rotating. The type elements on the disk are in a particular spiral configuration. The carrier also moves at a constant speed which is synchronized with the motion of the disk in such a manner that the desired character can be printed in each print position.

U.S. Pat. No. 4,030,591, Martin et al, issued June 21, 1977, discloses a rotating disk printer where the carrier is moving at a variety of velocities when the printing by the firing of the print hammer takes place. Thus, the firing of the print hammer must be timed dependent on the velocity of the carrier or carriage at the particular instance.

In U.S. Pat. No. 3,858,509, issued Jan. 7, 1975, a rotating disk printing apparatus is disclosed in which the striking force applied to the hammer can be varied between "light" and "hard". However, in that patent the printing is not done on-the-fly and there is no need to coordinate the speed of the carriage and the travel time of the print hammer to insure that the position of the character to be printed is at the print impact point at the time it is caused to strike the printing medium.

U.S. Pat. No. 4,035,781, L. H. Chang, issued July 12, 1977, mentions a procedure in a printer wherein upon a failure to print, at least one retry to print is made before the apparatus is stopped for an error correction routine. This patent does not involve on-the-fly printing wherein the carrier is never stopped. In the apparatus of the patent, the carrier appears to stop at each print position. Thus, it appears to be unrelated to the problem of synchronization of time related parameters in on-the-fly printers.

Further developments with rotating disk printers covered in a copending application Kane et al, Ser. No. 863,450 filed Dec. 22, 1977, the details of which are included in description of the embodiment of the present invention, relate to rotating disk printers in which the carrier is moving at a variety of velocities, the rotatable character disk is rotating over a variety of distances and the print hammer is driven at a variety of forces in order to achieve consistent and high print quality. Thus, the approach in the copending application adds a further element, i.e., variable hammer force which must be coordinated with a variable carriage velocity and variable disk rotation distance in order to achieve the desired synchronization of selected printed character with the selected carrier print position.

Thus, for many advanced impact printing operations, the impact means is driven at the variety of forces each determined by the combination of the variable escapement velocity and variation in hammer force required to achieve a consistant print quality with characters of different sizes. The result is that tolerances in impact means characteristics such as flight time are exceedingly close. Any minute variation in the impact means, i.e., hammer missile flight time due to wear or other minor misfunctions can seriously impede the operation of the impact printing apparatus. Also, a failure to achieve an exact coincident engagement of the missile with the selected type element on a print wheel can do serious damage to the print wheel and other parts of the printing apparatus. Consequently it is critical in advanced printing operations that means be provided for monitoring the flight time of impelled impact means such as missiles and that further means be provided for detecting whether the required coincident engagement of the impact means with the type element has been achieved.

Any variation in missile flight time will result in a variation in the horizontal alignment of the printed character in on-the-fly printers where printing occurs with the carrier in motion. Even more significantly and irrespective of whether printing is on-the-fly, the variation of flight time will result in a change in the impact energy which will result in a poor printed character; it may even damage the type element being struck, particularly if a relatively small character is struck with a relatively high energy. Another problem which can be highly disruptive to the operation of impact printing equipment occurs when the impact means, i.e., missile, fails to achieve coincident engagement with a selected type element on the print wheel. This can result in a bent or damaged wheel which may be hung-up on the missile. In such a situation, when the print wheel is subsequently rotated in the selection cycle, the movement can destroy the hung-up print wheel and damage the hammer mechanism.

In the past, attempts have been made to monitor missile flight time by using impact sensing means such as contact paint or piezoelectric sensing means on the printer platen or in the missile to determine the exact time of physical contact with the platen. With such approaches, by timing the period from when the missile firing pulse is initiated until contact with the platen is directly sensed, flight time may be determined. These direct contact approaches have not been very practical from a commercial viewpoint. One problem has been that the contact means are subject to sensing tolerances beyond what is required in the present day impact printer field. This may be due in part to the indefiniteness of the exact point of impact which can be sensed by contact means. This is due in part to the initial contact which must be made with the print wheel and the ribbon before contact is made with the platen.

BRIEF DESCRIPTION OF THE PRESENT INVENTION

Accordingly, it is an object of the present invention to provide means for accurately sensing the flight time of impelled impact means and for compensating for undesirable variations in said sensed flight time.

It is a further object of the present invention to provide such flight time sensing means which do not depend on directly sensing the actual impact of said impelled impact means.

It is another object of the present invention to provide means for detecting whether impact means and selected type element have achieved coincident engagement.

It is yet another object of the present invention to provide means for avoiding damage to the print wheels and other impact printer elements due to coincident engagement failure between impelled impact means and elements on the print wheel.

It is an even further object of the present invention to provide means for both accurately determining the flight time of impelled impact means and for sensing whether such impact means and a selected type element have achieved coincident engagement.

The above and other objects are achieved by providing an improvement in an impact printer including a print wheel, impact means impellable against the print wheel to drive the print wheel against a printing medium and means for impelling said print wheel. The improvement comprises the addition of means for determining the flight time of the impelled impact means by sensing velocity changes in said impact means and means responsive to said sensed flight time for controlling the impelling means to vary flight time in order to compensate for any undesirable variation.

The present invention involves a further improvement in impact means including a print wheel having a plurality of selectable character type bearing elements for respectively printing a plurality of characters, said print wheel being rotatable for selectively positioning selected type elements at successive print positions, impact means impellable against said selected elements to drive said elements against the printing medium and means for impelling said impact means against said selected type element. The improvement comprises means for detecting the coincident engagement of the impact means with the type element by sensing the velocity of the impact means after the impact means has reached a predetermined position at which coincident engagement should have been achieved if the apparatus was operating properly.

In the apparatus of the present invention, the velocity sensing means may readily and advantageously serve a dual purpose. The sensing means may be used to continuously sense velocity transitions in the impelled impact means as the platen is approached in order to determine the exact time of impact and to also sense the velocity of the impact means during the missile rebound period after impact. From the later sensed velocity, a determination can readily be made as to whether said coincident engagement between the missile and the print wheel element has been achieved.

BRIEF DESCRIPTION OF THE DRAWINGS

Referring now to the drawings, wherein a preferred embodiment of the invention is illustrated, and wherein like reference numerals are used throughout to designate like parts.

DETAILED DESCRIPTION OF THE PREFERRED EMBODIMENT

The improvements of the present invention may be readily implemented in the apparatus described in copending application Ser. No. 863,450, Kane et al, filed Dec. 22, 1977, U.S. Pat. No. 4,189,246, which is an on-the-fly printer apparatus capable of operating at variable carriage velocity as well as variable hammer impact energy in accordance with the size of the character to be printed. Consequently, if additional details of the apparatus described are needed, the subject patent application which is hereby incorporated into the present application should be referred to.

However, it should be recognized that the improvements of the present invention are not limited to impact printer apparatus of the specific type described in said copending application. Both the improvements related to sensing the flight time of the impelled missile and determining whether the missile has achieved coincident engagement with the print wheel may be practiced in printers which do not operate in the on-the-fly mode. Likewise, both of the above improvements may be practiced on impact printers which have only the single escapement velocity. In addition, both improvements may be practiced on apparatus in which the impact hammer or missile is driven with only a single impact energy.

Figure 1:
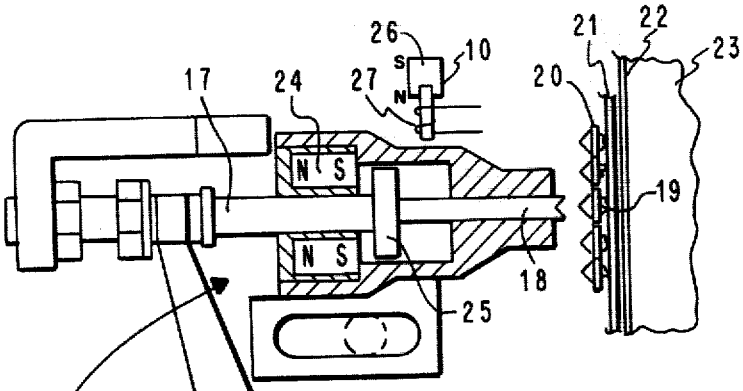
FIG. 1 is a diagrammatic partial, sectional top view of the print hammer structure of the present invention.

FIG. 1 shows the primary components of a hammer unit for an impact printer modified to include the sensing transducer unit 10 involved in the present invention. During the time period when the drive pulse is applied to the hammer unit, the missile driving solenoid 11 is activated. This moves armature 12 to close air gap 13 as it is drawn toward pole face 14 within operational coil 15. This in turn drives armature arm 16 against missile end 17 to drive missile tip 18 against one of the petals 19 of print wheel 20 which in turn will of course drive the selected petal 19 to impact through ribbon 21 against paper 22 on platen 23. When the drive pulse is removed from solenoid 11, the magnetic force being applied by permanent magnet 24 which surrounds missile 17 will pull steel flange 25 of the missile back against magnet 24 so that this magnetic force combined with the recoil or bounce of the missile after impact will restore the missile to its original position wherein flange 25 is adjacent magnet 24. It should be noted that in FIG. 1 the missile is shown at an initial position in the impact drive cycle.

As will be explained subsequently in greater detail, transducer 10 has the capability in combination with appropriate sense circuitry to determine both the flight time of missile 18 from the time when the drive pulse is started until impact with paper 22 and to determine the velocity of missile 18 at a selected point during the flight of the missile. Transducer 10 may most conveniently be a variable reluctance type transducer which operates on the principle of sensing the lines of flux provided by the combination of permanent magnet 24 and supplementary permanent magnet 26 being cut by missile 18 during the movement of the missile. This change in the permeance of the magnetic circuit caused by the cutting of the lines of flux causes a voltage to develop in the coil 27 of the transducer 10. This voltage is sensed by the sensing circuits as will be subsequently described to provide a parameter utilizable to determine both missile velocity and missile flight time.

Figure 2:
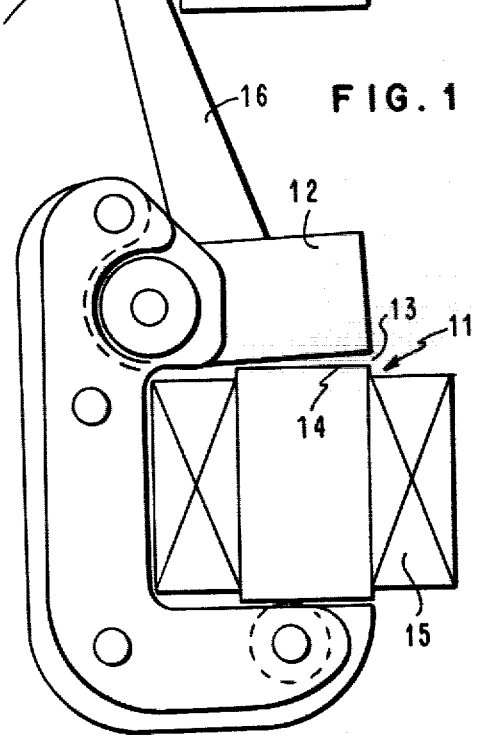
FIG. 2 is a partial diagrammatic side view showing the relationship of the hammer missile to a print wheel petal prior to missile firing.
Figure 2:
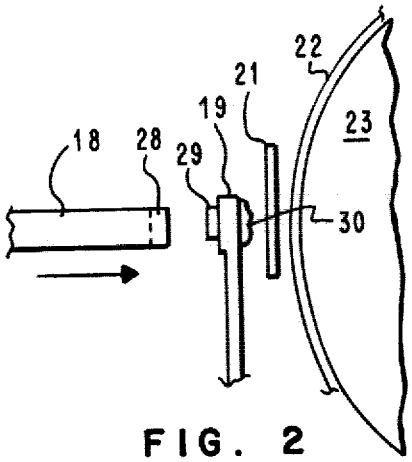
Figure 3:
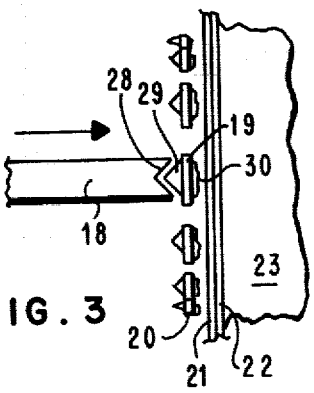
FIG. 3 is a partial diagrammatic top view showing the coincident engagement of the hammer missile of FIG. 2 with a print wheel character petal when an operative capture of the petal is made.

As shown in greater detail in FIGS. 2 and 3, missile tip 18 has a notch 28 which will register with a corresponding projection 29 on petal 19 when the missile tip has made a proper coincident engagement with petal 19. Then, the impression of type character 30 will be driven through ribbon 21 onto paper 22.

In measuring the flight time of missile 18, we will consider the flight time to be the period of time between the point when the drive pulse is started until the point when missile 18 has driven petal 19 against the platen 23 and the missile velocity is essentially reduced to zero before it rebounds back towards its initial position.

Figure 5:
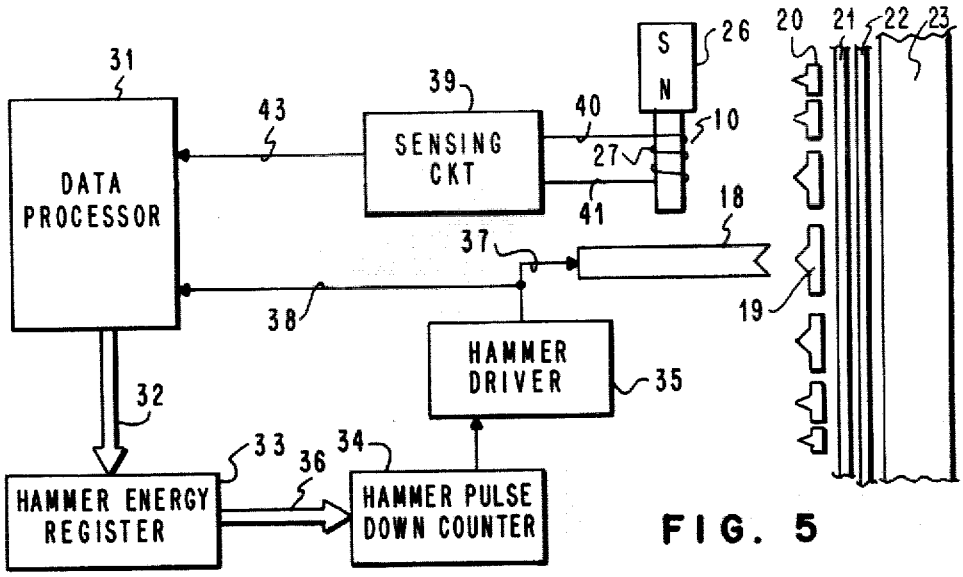
FIG. 5 is a schemmatic diagram primarily in block form of the logic circuitry for carrying out the flight time sensing and coincident engagement detection in accordance with the present invention.

Let us now consider how the missile flight time is monitored in accordance with the present invention. First, with reference to FIG. 5, the apparatus of the present invention for sensing and determining the flight time of the impelled missile will now be described. In the diagram of FIG. 5, the missile is diagrammatically represented by missile tip 18. As for the other logic elements shown in FIG. 5, the units described in above mentioned U.S. Patent Application Ser. No. 863,450 may be used. Data processor 31 may be any suitable computer or microprocessor utilized for printer control. Assuming a microprocessor is used for processor 31, it receives the input data from the printer and from other sources and makes certain calculations involving that data and then sends a series of binary numbers out on buss 32 to control operations within the printer.

A conventional hammer driving cycle is carried out as follows. Assuming the print wheel has reached its selected petal position, and the escapement has reached its selected print position, the firing of the hammer is ready to commence. As indicated in copending application No. 863,450, the energy provided by the missile 18 against the print wheel petal 19 will be variable dependent upon the size of the character to be printed. Thus, in preparation for this firing, the byte of binary data has been transmitted from the data processor over buss 32 and stored in the hammer energy register 33 of the printer which controls the hammer pulse down counter 34. Then, as described in said copending application, upon an appropriate sync pulse to the hammer down counter indicating that both the print wheel and escapement are at print positions, the hammer pulse down counter will commence to count down and provide a firing pulse to the hammer driver 35 which will in turn activate the solenoid 11 (FIG. 1) to drive missile 18 until down counter reaches zero. Of course, the count in hammer pulse down counter 34 is controlled by the binary byte in register 33 provided to the down counter over buss 36. Upon the completion of the count, hammer driver 35 will be turned off and missile 18 will begin the unpowered portion of its flight to carry petal 19, ribbon 21, into an impact with paper 22 and platen 23.

Figure 6:
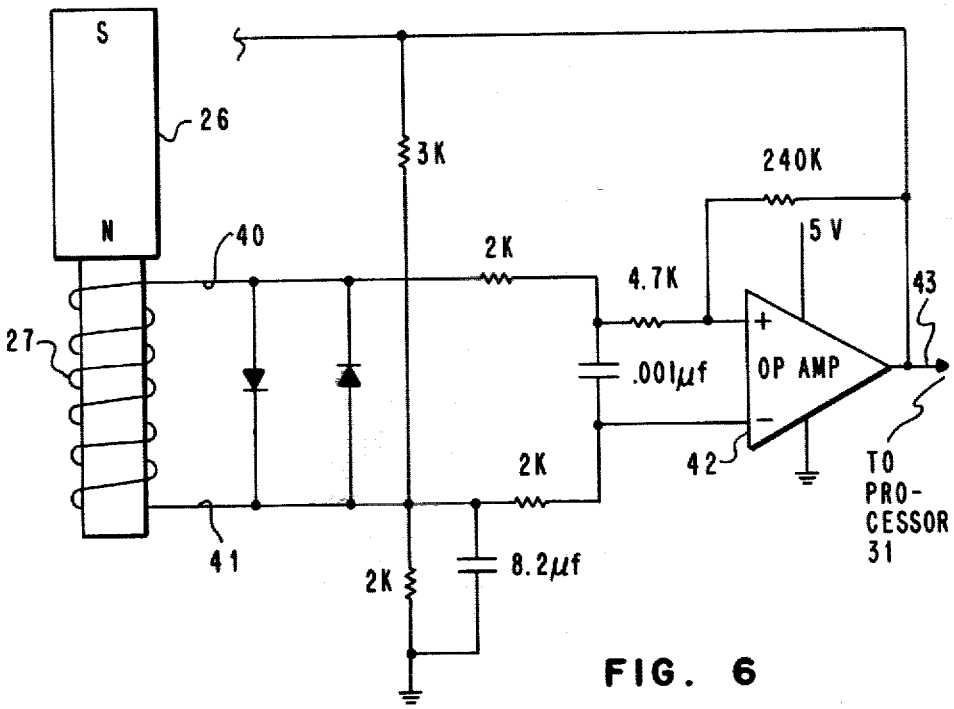
FIG. 6 shows the transducer and sensing circuit of FIG. 5 in detail for the case where the sensing circuit functions to sense missile flight time.

With reference to FIG. 5 during the hammer driving operation described above, flight time of the hammer is sensed as follows. When hammer driver 35 commences to apply the drive input to drive solenoid 11 (FIG. 1) as is indicated diagrammatically by the input along line 37 in FIG. 5, an initial signal is sent to data processor 31 along line 38 to commence a flight time count by the data processor. As the missile moves towards the platen through the magnetic field produced by the combination of permanent magnet 26 and permanent magnet 24 (FIG. 1), a voltage is produced in transducer coil 27 (FIG. 5) by the change in flux resulting from the movement. This voltage level across coil 27 is applied to the sensing circuit 39 across lines 40 and 41. Sensing circuit 39 which is shown in detail in FIG. 6 is a zero sensing circuit, i.e., when hammer missile 18 reaches the zero velocity or stop point before rebounding from the platen, the voltage across coil 27 transmitted through lines 40 and 41 to the sensing circuit of FIG. 6 will be zero volts. This will cause comparator 42, FIG. 6, which is biased to provide an output only when there is no voltage difference between lines 40 and 41 to provide a signal along line 43 to data processor 31 which will stop the flight time counter in the data processor.

Figure 9:
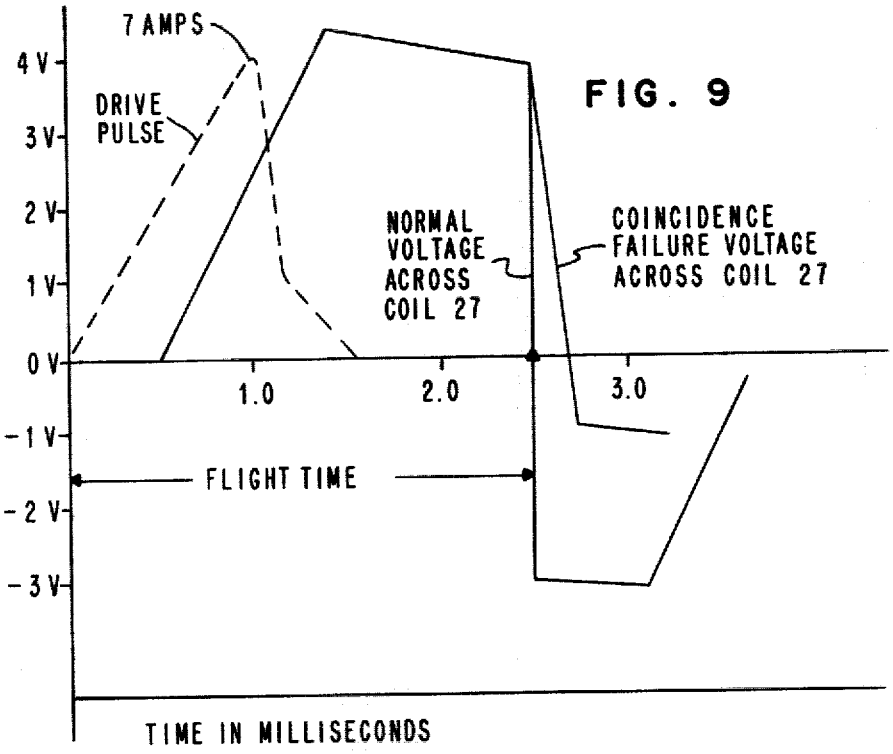
FIG. 9 is a timing graph showing the variation in voltage level across transducer coil with time under two different conditions.

This operation may be better understood with reference to FIG. 9 which shows the change in voltage across coil 27 with time. The drive pulse from the hammer driver 35 (FIG. 5) to drive the missile is shown in dashed lines in FIG. 9 as a current value. The resulting voltage across coil 27 is indicated as a solid line trace.

The energy applied to the hammer missile will vary with the width of the drive pulse which is controlled by the count in hammer pulse counter 34 (FIG. 5). For the drive pulse width indicated in FIG. 9, the missile reaches the platen after 2.5 milliseconds as indicated by the voltage across coil 27 dropping to the zero value at that point. Thus, after 2.5 milliseconds, the sensing circuit of FIG. 6 will provide a signal on line 43 to data processor 31 to terminate the flight time count which is being conducted in the processor. Based upon this sensed flight time count, the processor calculates the flight time, compares the same with the predetermined value stored in the processor indicating what the flight time should have been for the selected hammer energy level and makes an adjustment in the hammer drive pulse if there is a variation in the flight time beyond preset tolerance levels.

Figure 8:
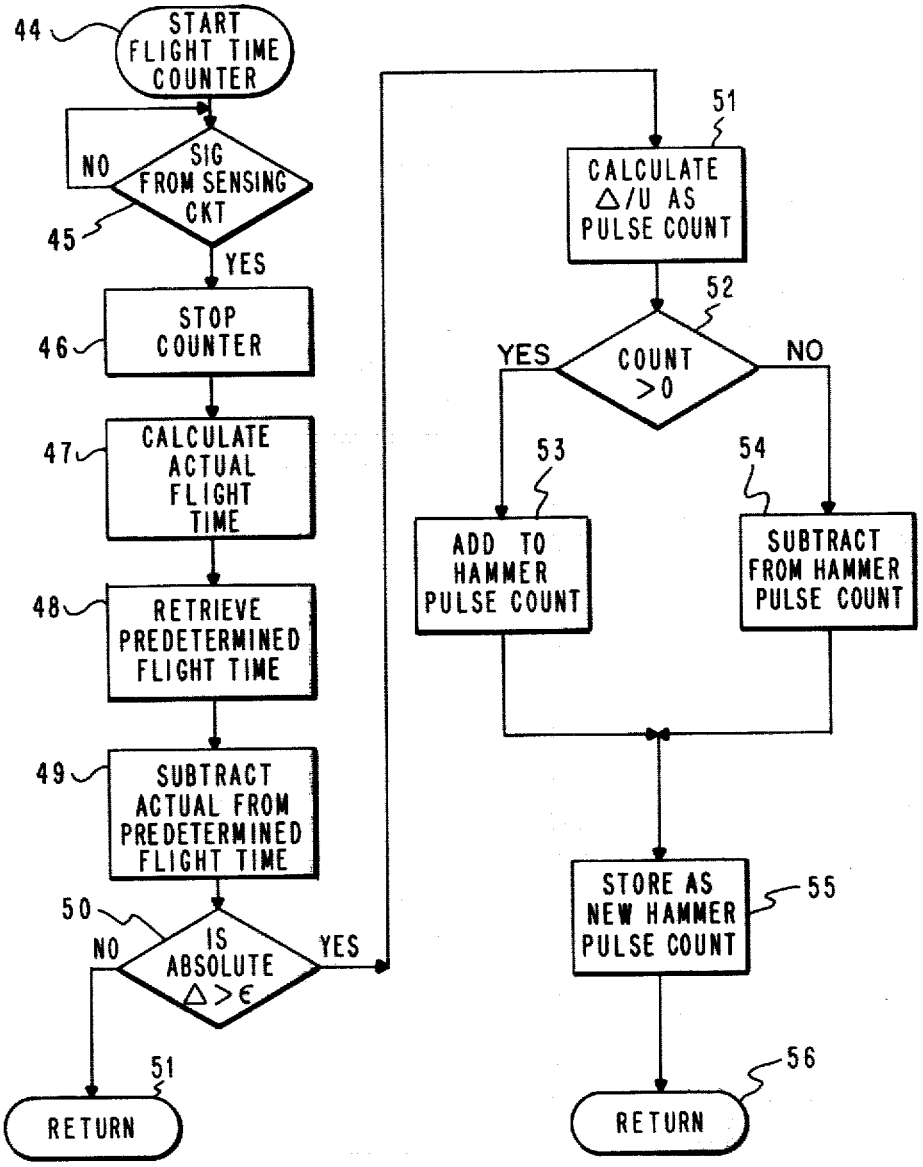
FIG. 8 is a flow chart depicting the sequence of operations carried out by the printer control circuitry in combination with the controlling processor in the case where flight time is being sensed.

The flow chart in FIG. 8 sets forth the operation which may be carried out in data processor 31 in order to calculate the flight time. The flow chart will be best understood when considered in connection with FIG. 5. FIG. 8, block 44, upon the sending of signal on line 38 that the hammer drive pulse has commenced, a flight time counter in data processor 31 is commenced. The count is continued until a signal is received from the sensing circuit along line 43 indicating that the forward drive motion of missile 18 has stopped, block 45. The flight time counter in the processor 31 is stopped, block 46. Based upon a predetermined time increment represented by each unit in the flight time count, the actual flight time is calculated, block 47. The processor has stored therein a predetermined flight time which the selected energy level drive pulse driving missile 18 through driver 35 should have produced; this predetermined flight time is retrieved from storage, block 48. The actual flight time is subtracted from this predetermined flight time, block 49. Then, block 50, a determination is made as to whether $\Delta$, the absolute difference between actual and predetermined flight time, is greater than $\epsilon$; $\epsilon$ is a predetermined maximum variation tolerance in flight time below which no adjustment in flight time needs to be made. Thus, if the value of $\Delta$ is not greater than $\epsilon$, an adjustment need not be made, and the operation is complete. Processor may be returned to the next print cycle, block 51.

On the other hand, if $\Delta$ is greater than $\epsilon$, there is an indication that wear and tear in the printing equipment has resulted in a state wherein the pulse width provided by the hammer driver to drive the hammer solenoid is inadequate. Consequently, the width of the drive pulse which has been stored as a data byte in the data processor 31 capable of producing a specific hammer pulse count in hammer pulse counter 34 controlling driver 35 will have to be adjusted to reflect this change. This is carried out as follows with respect to FIG. 8. Each unitary count U (base time increment) provided by hammer pulse counter 34 results in a predetermined unit of flight time provided by driver 35. Thus, $\Delta/U$ is calculated, block 51. The result will be a pulse count. If the pulse count is greater than zero as determined in block 52, i.e., the additional pulse count is positive, the binary representation of the particular hammer energy level stored in the processor is changed so that the new pulse count will be the original count with the calculated pulse count added to it, block 53. On the other hand, if the pulse count is negative, the binary value as stored in the processor block 54 is changed to represent the difference between the original count and the calculated pulse count. Then, block 55, the binary value of the new pulse count which will produce the adjusted pulse from counter 34 to driver 35 for the particular energy level is stored in processor 31 and the processor is returned to the next print cycle, block 56.

Figure 4:
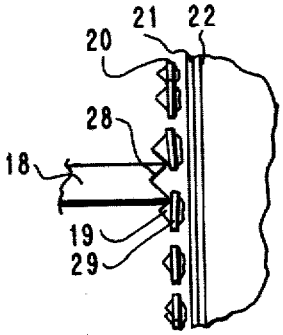
FIG. 4 is the same view as FIG. 3 except for a condition where the missile has failed to achieve coincident engagement, i.e., capture the petal.

The apparatus of the present invention has the further capability of detecting a coincidence failure between the missile tip 18 and the selected petal 19 which it is to engage during a particular print cycle. In such a coincidence failure, which is shown in FIG. 4, notch 28 in missile 18 does not line up with projection 29 on petal 19. This is usually due to some error in the positioning of the print wheel during the character selection cycle. When this occurs, the missile may drive between two of the petals in the print wheel 20 resulting in a misstrike on the surface of paper 22. Such a misstrike presents serious printer problems beyond the mere failure to print a single character. The print wheel is frequently twisted or it may be hung up on the missile. In either case, it is critical that the print wheel not be rotated any further in a subsequent character select cycle. The transducer 10 of the present invention detects such a coincident failure or misstrike by monitoring the velocity of the missile after the paper has been struck, i.e., velocity of the missile during the rebound. This may be better understood by reference to the timing graph in FIG. 9. In the case of a normal hammer missile strike where coincident engagement has been achieved, the curve of the voltage across coil 27 may be expected to achieve a given negative voltage level indicative of a given rebound or opposite velocity. In the present example, this level should be minus 3 volts. On the other hand, where there is a coincidence failure, i.e., misstrike, the rebound velocity will be much slower. As indicated by the curve in FIG. 9, the representative negative voltage across coil 27 will be much below the normal minus 3 volts or in the order of minus 1 volt or less. In order to detect such a coincidence failure, the sensing circuit 39 (FIG. 5) should contain the circuit unit shown in FIG. 7. Variable resistor 57 may be selectively adjusted so as to bias operational amplifier 58 to pass a signal on line 59 to processor 31 if the voltage across the coil on lines 40 and 41 fails to reach minus 3 volts.

If the processor 31 receives such a signal, it will halt further selection operations which will prevent wheel 20 from being rotated and consequently damaged.

Figure 7:
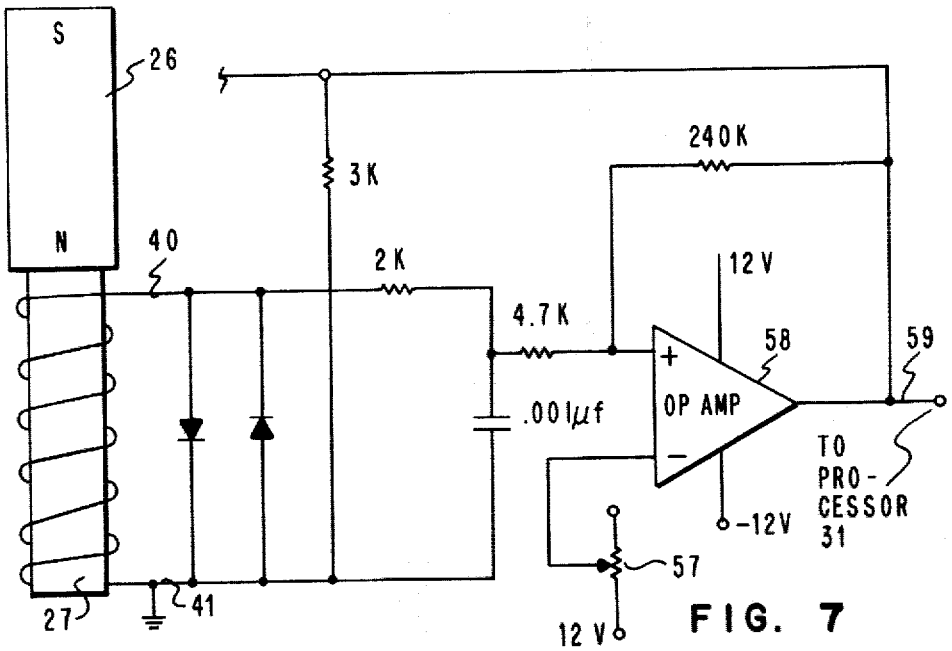
FIG. 7 is a detailed view of the transducer and sensing circuit of FIG. 5 when the sensing circuit functions to detect missile velocity in order to determine whether coincident engagement of the missile with the print wheel petal has been achieved.

Sensing circuit 39 (FIG. 5) may contain both the flight time detection circuit of FIG. 6 and the velocity sensing circuit of FIG. 7 in which case transducer 10 will operate to both sense flight time of the missile as well as sensing the negative velocity of the missile in order to determine whether a coincident engagement of the missile with the selected print wheel petal has been achieved.

While the invention has been particularly shown and described with reference to a preferred embodiment it will be understood by those skilled in the art that various other changes in form and detail may be made without departing from the spirit and scope of the invention.

What is claimed is:

1. In an impact printer including a print wheel having a plurality of selectable character type bearing elements for respectively printing a plurality of characters, said print wheel being rotatable for selectively positioning selected type elements at successive print positions, impact means impellable against said selected elements to drive said elements against a printing medium and means for impelling said impact means against said selected type element, the improvement comprising:

means for detecting the coincident engagement of said impact means with a type element by sensing the velocity of said impact means after said impact means has reached a predetermined coincident engagement position.

2. The impact printer of claim 1 wherein said impact means comprises a print hammer missile.

3. The impact printer of claim 2 wherein each of said type elements includes a member adapted to receive and center said missile with respect to the type element and said missile includes a member adapted to register with said receiving member to effect said coincident engagement.

4. The impact printer of claim 3 wherein said registered members comprise a registered projection and notch.

5. The impact printer of claim 3 wherein said sensing means comprises magnetic transducer means positioned along the path of said missile.

6. The impact printer of claims 1 or 3 further including means for preventing further rotation of said print wheel upon a detected failure in coincident engagement.

7. The impact printer of claim 1 wherein said means for sensing the velocity of said impact means also senses velocity changes in said impact means, and further including means responsive to said sensed velocity changes for determining the flight time of said impelled impact means, and means responsive to said flight time determination for controlling impelling means to vary said flight time.

8. The impact printer of claim 7 wherein said impact means comprises a print hammer missile.

9. The impact printer of claim 8 wherein each of said type elements include a member adapted to receive and center said missile with respect to the type element and said missile further includes a member adapted to register with said receiving member to effect said coincident engagement.

10. The impact printer of claim 9 wherein said sensing means comprises magnetic transducer means positioned along the path of said missile.

* * * * *